US009564045B2

(12) United States Patent
Ainsworth et al.

(10) Patent No.: US 9,564,045 B2
(45) Date of Patent: Feb. 7, 2017

(54) ALARM SYSTEM TESTING DEVICE

(71) Applicants: Stephen D. Ainsworth, Whitby (CA); Larry C. Geoghegan, Whitby (CA)

(72) Inventors: Stephen D. Ainsworth, Whitby (CA); Larry C. Geoghegan, Whitby (CA)

( * ) Notice: Subject to any disclaimer, the term of this patent is extended or adjusted under 35 U.S.C. 154(b) by 249 days.

(21) Appl. No.: 14/252,157

(22) Filed: Apr. 14, 2014

(65) Prior Publication Data

US 2015/0294556 A1 Oct. 15, 2015

(51) Int. Cl.
*G08B 29/00* (2006.01)
*G08B 29/12* (2006.01)

(52) U.S. Cl.
CPC ..... *G08B 29/123* (2013.01); *G08B 29/00* (2013.01)

(58) Field of Classification Search
CPC ..... G08B 29/123; G08B 29/00
See application file for complete search history.

(56) References Cited

U.S. PATENT DOCUMENTS 2,043,210 A * 6/1936 Grant, Jr. ..... G08B 19/005 340/508
3,559,196 A * 1/1971 Scheidweiler ..... G08B 17/11 250/386
3,564,524 A * 2/1971 Walthard ..... G08B 29/145 340/515
3,582,557 A * 6/1971 Friberg ..... H04M 11/045 379/37
3,668,682 A * 6/1972 Barbee ..... G08B 25/14 340/286.05
3,686,668 A * 8/1972 Durkee ..... G08B 19/00 340/293
4,148,019 A * 4/1979 Durkee ..... G08B 25/00 340/521
4,180,287 A * 12/1979 Youngblood ..... E05B 65/0017 292/144
4,742,334 A * 5/1988 Teich ..... G08B 26/005 340/3.51
4,948,044 A * 8/1990 Cacciatore ..... H02J 9/061 165/238
4,954,809 A * 9/1990 Right ..... G08B 29/06 340/505
5,008,840 A * 4/1991 DePierro ..... G08B 29/145 340/506
5,297,011 A * 3/1994 Triunfol ..... E04F 19/028 362/147

(Continued)

FOREIGN PATENT DOCUMENTS

JP 5164194 3/2013
KR 101175151 8/2012

*Primary Examiner* — Joseph Feild
*Assistant Examiner* — Rufus Point

(57) ABSTRACT

An alarm system testing device facilitates simulation of a trouble condition and testing circuit continuity of an alarm system within a structure. The device includes an alarm system comprising an electrical circuit, an alarm, a resistor, and at least one trigger. The alarm is activated by the trigger shorting a positive rail of the electrical circuit to a negative rail. A testing switch has a ground position wherein the positive rail of the electrical circuit is grounded when the testing switch is in the ground position. The resistor is electrically coupled to the testing switch such that positioning the testing switch in a resistor bypass position removes the resistor from the electrical circuit.

2 Claims, 5 Drawing Sheets

(56) References Cited

U.S. PATENT DOCUMENTS

| | | | | |
|---|---|---|---|---|
| 5,343,461 | A * | 8/1994 | Barton | H04L 1/24 370/249 |
| 5,438,607 | A * | 8/1995 | Przygoda, Jr. | H04M 11/04 379/38 |
| 6,341,981 | B1 * | 1/2002 | Gorman | H01R 13/652 174/53 |
| 6,631,063 | B2 * | 10/2003 | Ortiz | H05B 41/2851 361/79 |
| 8,299,911 | B2 * | 10/2012 | Buss | G08B 25/04 340/507 |
| D676,814 | S | 2/2013 | Paul | |
| 2002/0055301 | A1 * | 5/2002 | Gorman | H01R 13/652 439/535 |
| 2003/0189804 | A1 * | 10/2003 | Kampmeyer | H02H 3/33 361/42 |
| 2005/0217872 | A1 * | 10/2005 | Oh | G08B 25/08 169/67 |
| 2012/0320955 | A1 * | 12/2012 | Ueda | H04W 52/0274 375/219 |
| 2013/0001022 | A1 * | 1/2013 | Marien | G05B 9/02 187/390 |
| 2013/0173939 | A1 * | 7/2013 | Peto | H04L 12/10 713/300 |
| 2015/0294556 | A1 * | 10/2015 | Ainsworth | G08B 29/123 340/514 |

* cited by examiner

ALARM SYSTEM TESTING DEVICE

BACKGROUND OF THE DISCLOSURE

Field of the Disclosure

The disclosure relates to testing devices and more particularly pertains to a new testing device for facilitating simulation of a trouble condition and testing circuit continuity of an alarm system within a structure.

SUMMARY OF THE DISCLOSURE

An embodiment of the disclosure meets the needs presented above by generally comprising an alarm system comprising an electrical circuit, an alarm, a resistor, and at least one trigger. The alarm is activated by the trigger shorting a positive rail of the electrical circuit. A testing switch has a ground position wherein the positive rail of the electrical circuit is grounded when the testing switch is in the ground position. The resistor is electrically coupled to the testing switch such that positioning the testing switch in a resistor bypass position removes the resistor from the electrical circuit.

There has thus been outlined, rather broadly, the more important features of the disclosure in order that the detailed description thereof that follows may be better understood, and in order that the present contribution to the art may be better appreciated. There are additional features of the disclosure that will be described hereinafter and which will form the subject matter of the claims appended hereto.

The objects of the disclosure, along with the various features of novelty which characterize the disclosure, are pointed out with particularity in the claims annexed to and forming a part of this disclosure.

BRIEF DESCRIPTION OF THE DRAWINGS

The disclosure will be better understood and objects other than those set forth above will become apparent when consideration is given to the following detailed description thereof. Such description makes reference to the annexed drawings wherein.

DESCRIPTION OF THE PREFERRED EMBODIMENT

Figure 1:
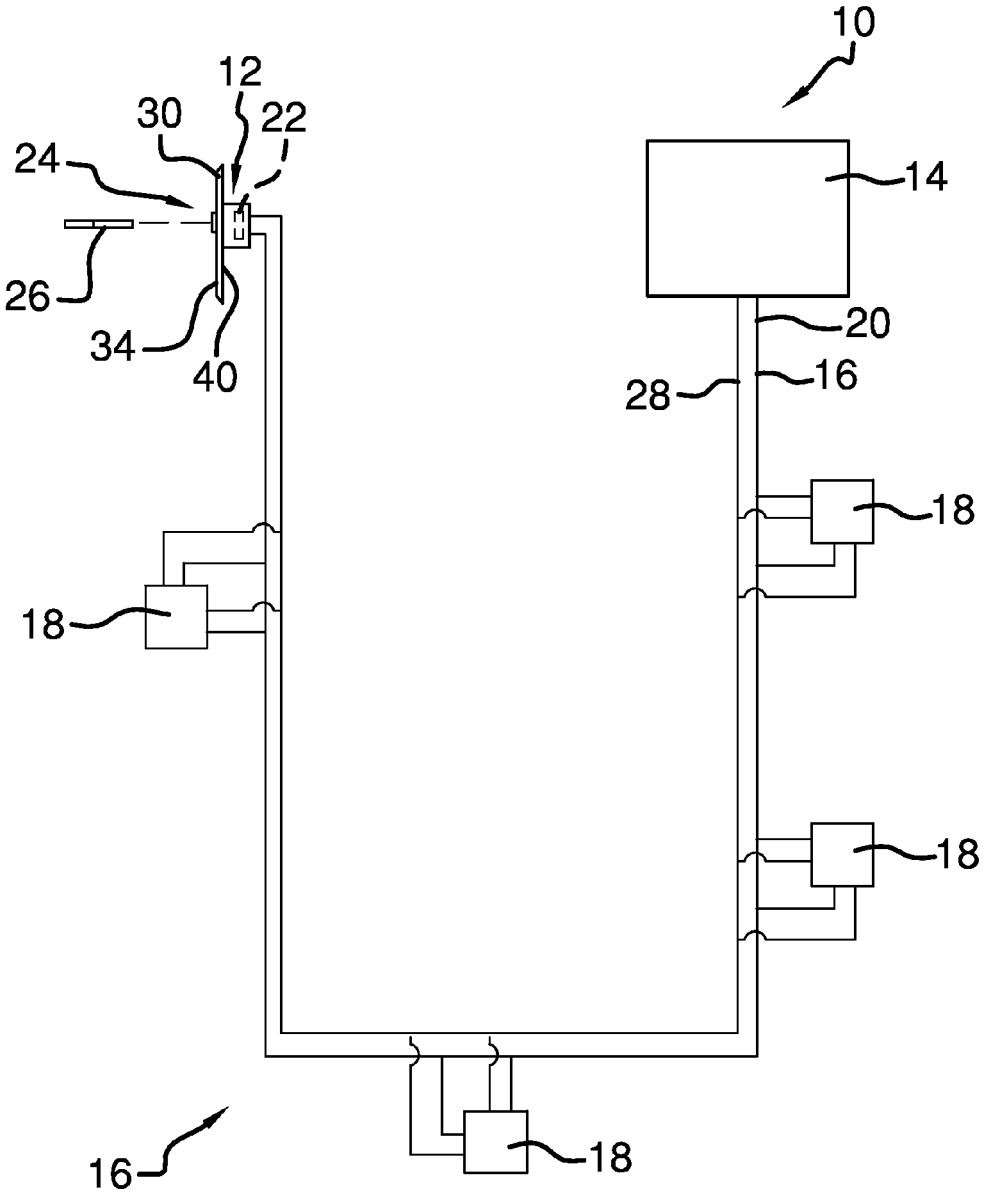
FIG. 1 is a schematic view of an alarm system testing device according to an embodiment of the disclosure.

With reference now to the drawings, and in particular to FIGS. 1 through 5 thereof, a new testing device embodying the principles and concepts of an embodiment of the disclosure and generally designated by the reference numeral 10 will be described.

As best illustrated in FIGS. 1 through 5, the alarm system testing device 10 generally comprises a testing switch 12 which is used to create conditions in an alarm system 14 so that the working condition of the alarm system 14 may be tested. The alarm system 14 is of the type commonly found in public buildings having multiple types of triggers 18 such as heat detectors, smoke detectors, carbon monoxide detectors, pull stations and the like. Each of the triggers 18 is electrically coupled in parallel to an electrical circuit 16 of the alarm system 14. Each trigger 18 conventionally functions to indicate an alarm condition by shorting a positive rail 20 of the electrical circuit 16 to a negative rail 28, a condition detected by a control mechanism of the alarm system 14 which may then sound an alert or initiate another programmed response subsequent to grounding of the positive rail 20 to the negative rail 28. The alarm system 14 further tests for a problem or trouble condition relating to the status or readiness of the trigger 18 by the positive rail 20 being shorted to ground. The alarm system 14 may incorporate programming or electrical connections to identify which specific trigger 18 is grounding the electrical circuit 16.

As is conventionally known, the alarm system 14 typically includes a resistor 22 electrically coupled to the electrical circuit 16 at an end of the line subsequent to all triggers 18 to identify the end of the line for the electrical circuit 16 and facilitate testing that the electrical circuit 16 is properly functioning. As can happen over time, additions to a structure may result in changes to the alarm system 14 wherein a particular resistor 22 is bypassed when new triggers 18 are added to an existing electrical circuit 16 of the alarm system 14 such that the existing resistor 22 is no longer positioned at the end of the line for the electrical circuit 16. Thus, it is important to test for active connection of the resistor 22 to be sure the testing of the alarm system 14 is taking place at the end of the line such that the testing will properly test an entirety of the electrical circuit 16. For conventional testing of the electrical circuit 16, the resistor 22 is accessed and the wiring physically manipulated to remove the resistor 22 from the electrical circuit 16, a condition detectable by the control mechanism of the alarm system 14. If removal of the resistor 22 from the electrical circuit 16 is detected, the resistor 22 is known to be part of the electrical circuit 16 and the end of the line is positively identified. If removal of the resistor 22 is not detected, the resistor 22 was already removed from the electrical circuit 16 and another resistor 22 at the true end of the line must be found to properly test the alarm system 14.

The testing switch 12 is electrically coupled to the electrical circuit 16. The testing switch 12 has a ground position schematically shown in FIG. 3. In the ground position the positive rail 20 of the electrical circuit 16 is grounded by the testing switch 12. This provides the same indication to the control mechanism of the alarm system 16 that is provided by one of the triggers 18. Thus, if the alarm system 16 does not detect the testing switch 12 being in the ground position, the alarm system 16 is known to be faulty.

Figure 2:
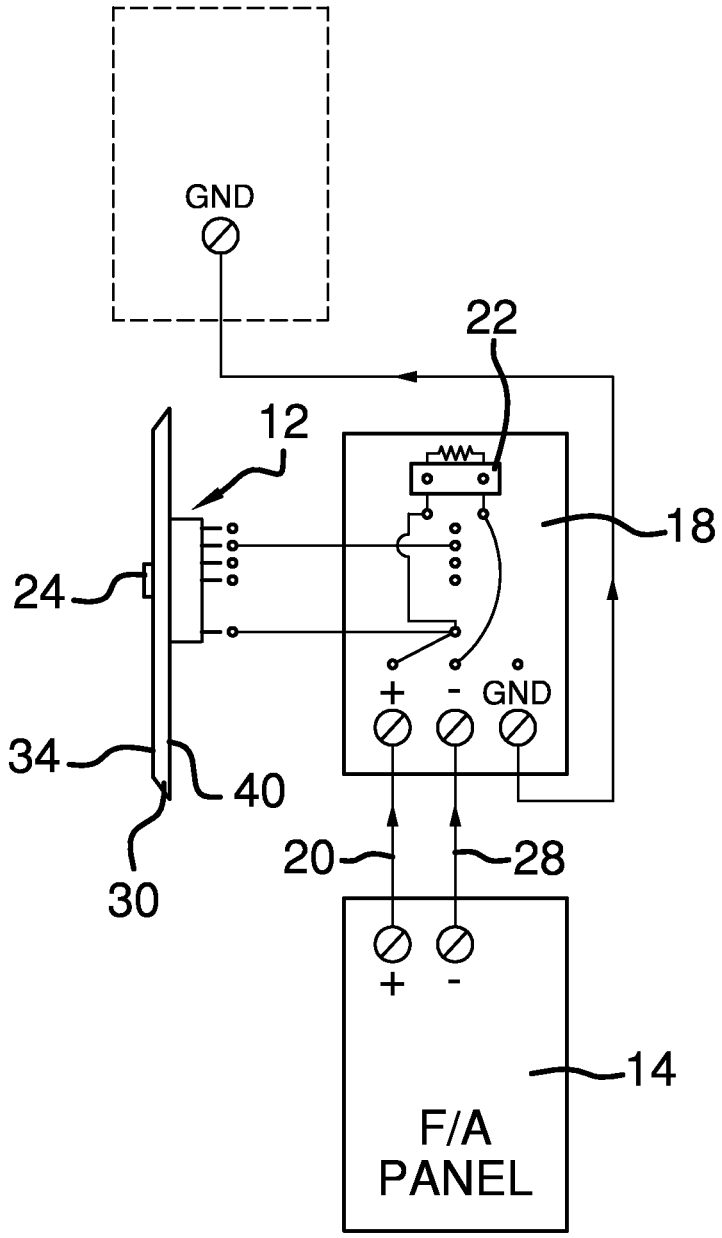
FIG. 2 is a schematic view of an embodiment of the disclosure in a passive normal use position.
Figure 3:
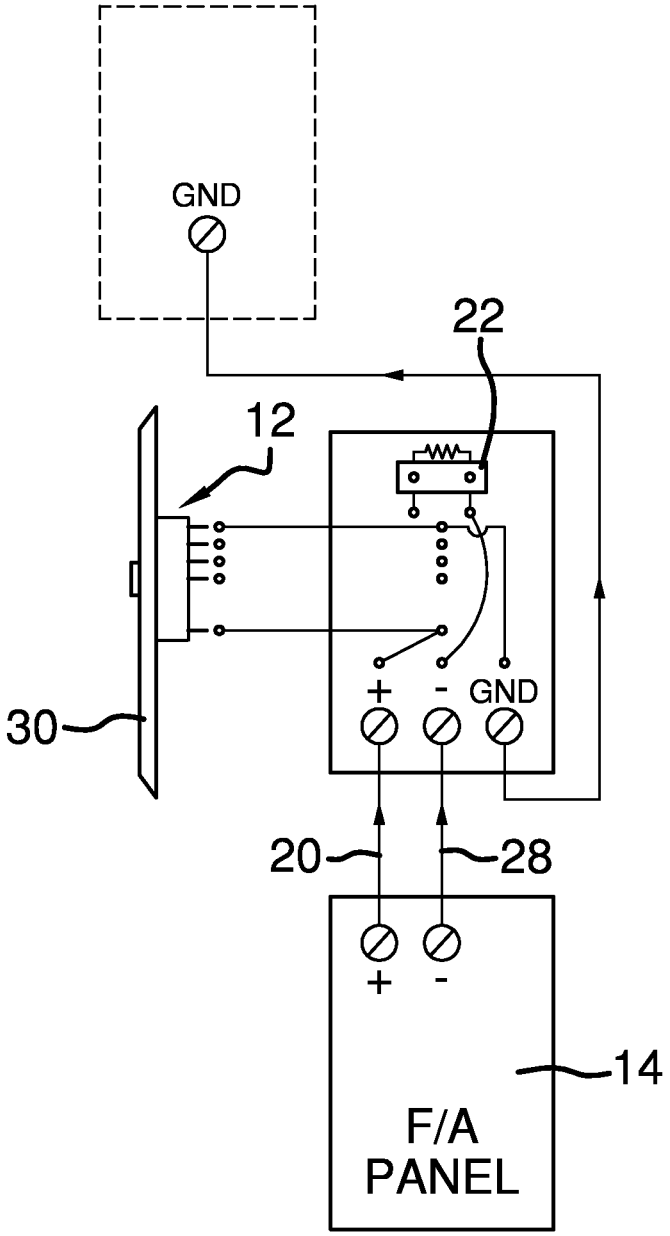
FIG. 3 is a schematic view of an embodiment of the disclosure in a position simulating a trouble condition.
Figure 4:
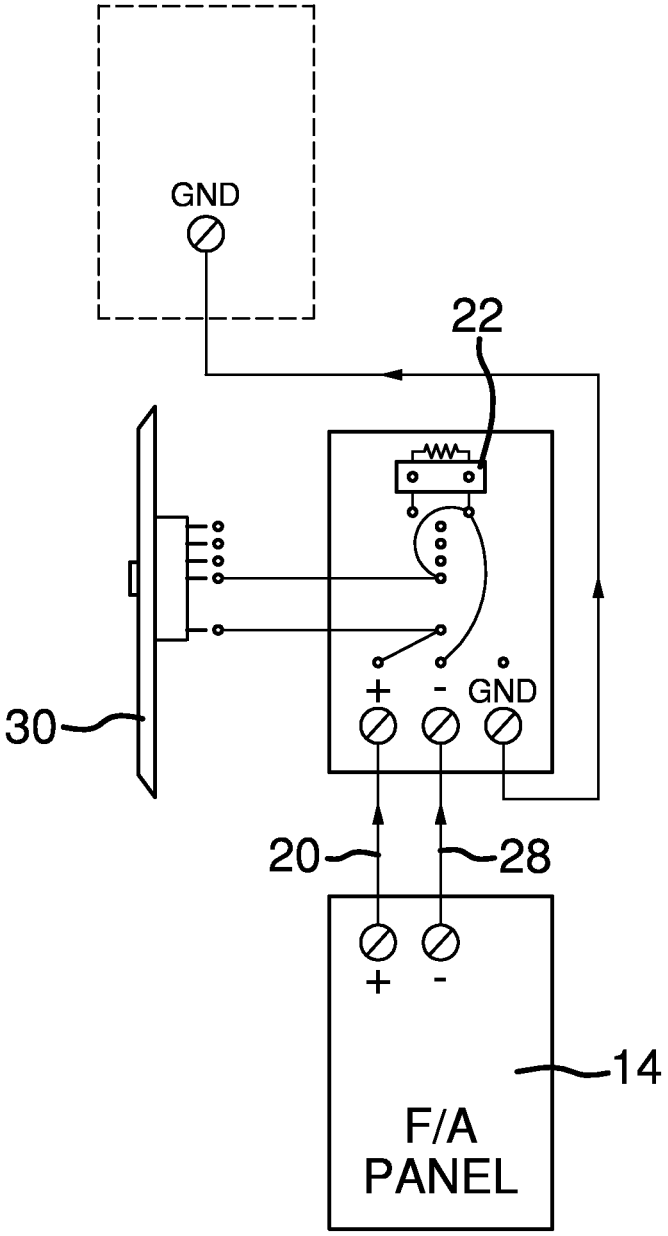
FIG. 4 is a schematic view of an embodiment of the disclosure in a position testing bypass of an end line resistor.
Figure 5:
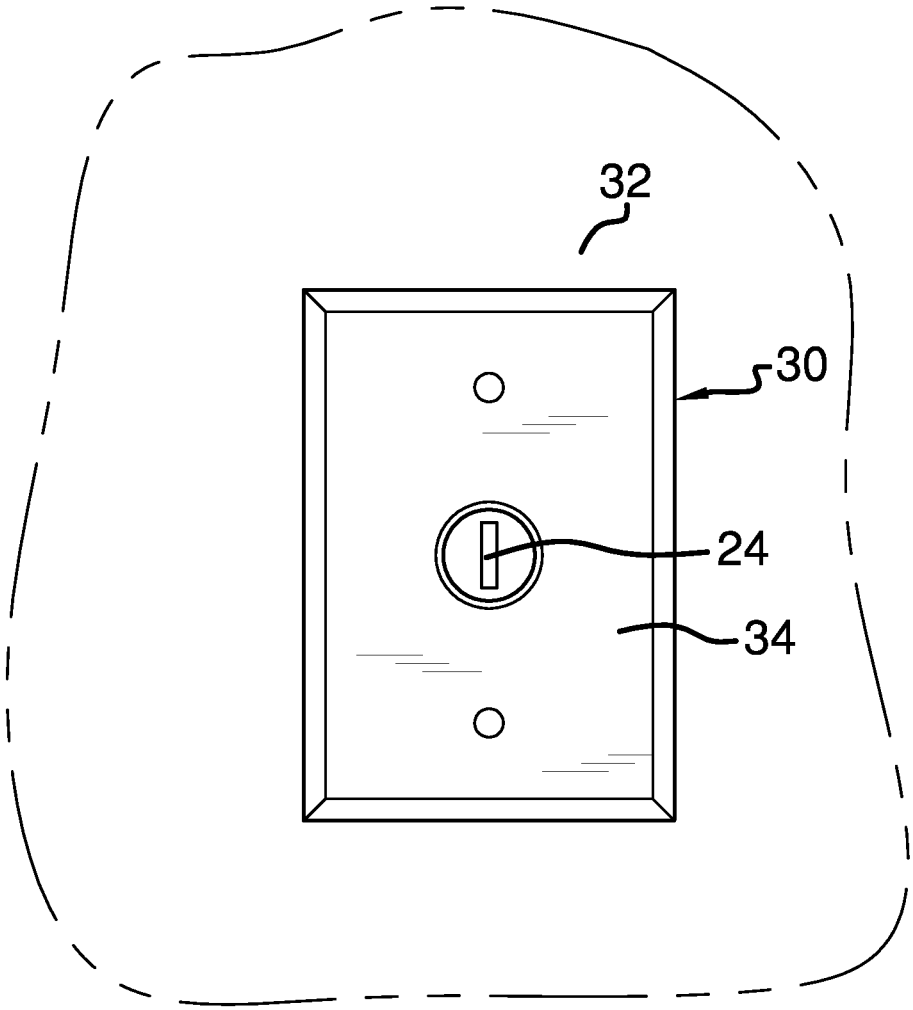
FIG. 5 is a front view of an alarm system testing device according to an embodiment of the disclosure.

The resistor 22 at the end of the line is electrically coupled to the testing switch 12 such that positioning the testing switch 12 in a resistor bypass position shown schematically in FIG. 4. The resistor bypass position removes the resistor 22 from the electrical circuit 16. As discussed above, if the alarm system 12 detects the resistor was in the electrical circuit 16 and removed, the end of the line for the electrical circuit has been positively identified and testing of the entire electrical circuit 16 may be performed at that position. The testing switch 12 also has a passive position shown schematically in FIG. 2. The passive position electrically separates the positive rail 20 of the electrical circuit 16 from a negative rail 28 of the electrical circuit 16 preventing shorting of the positive rail 20 to either the negative rail 28 or ground, allowing the alarm system 14 to function in a normal manner. As shown in FIG. 2, the testing switch 12 electrically couples the positive rail 20 to the negative rail 28 through the resistor 22.

The testing switch 12 provides a key hole 24 configured for receiving a key 26 wherein the testing switch 12 is switched into a selectable position by the key 26. A faceplate 30 is configured for coupling to a wall surface 32 exposing an exterior side 34 of the faceplate 30 on the wall surface 32 similar to a light switch or the like. The testing switch 12 is coupled to an interior side 40 of the faceplate 30 wherein the testing switch 12 is configured for being positioned in a building structure in the same manner as a conventional light switch or the like. The key hole 24 is exposed on the exterior side 34 of the faceplate 30 to be accessible and allow testing of the alarm system 14 without having to remove a covering or create an access hole in the wall to access the resistor 22 to test the alarm system 14. The faceplate 30 may be marked to indicate the positions described above or may be blank as shown.

With respect to the above description then, it is to be realized that the optimum dimensional relationships for the parts of an embodiment enabled by the disclosure, to include variations in size, materials, shape, form, function and manner of operation, assembly and use, are deemed readily apparent and obvious to one skilled in the art, and all equivalent relationships to those illustrated in the drawings and described in the specification are intended to be encompassed by an embodiment of the disclosure.

Therefore, the foregoing is considered as illustrative only of the principles of the disclosure. Further, since numerous modifications and changes will readily occur to those skilled in the art, it is not desired to limit the disclosure to the exact construction and operation shown and described, and accordingly, all suitable modifications and equivalents may be resorted to, falling within the scope of the disclosure. In this patent document, the word "comprising" is used in its non-limiting sense to mean that items following the word are included, but items not specifically mentioned are not excluded.

A reference to an element by the indefinite article "a" does not exclude the possibility that more than one of the element is present, unless the context clearly requires that there be only one of the elements.

We claim:

1. An alarm system testing device comprising:

an alarm system comprising an electrical circuit, said alarm system including an alarm and at least one trigger, said alarm being activated by said trigger shorting a positive rail of said electrical circuit to a negative rail, said alarm system comprising a resistor electrically coupled to said circuit, said resistor being positioned at an end of a line subsequent to all of said triggers;

a faceplate configured for coupling to a wall surface exposing an exterior side of said faceplate on the wall surface; and a testing switch electrically coupled to said electrical circuit, said testing switch having a ground position wherein said positive rail of said electrical circuit is grounded when said testing switch is in said ground position, said resistor being electrically coupled to said testing switch such that positioning said testing switch in a resistor bypass position removes said resistor from said electrical circuit whereby said resistor being positioned at the end of the line subsequent to all said triggers is verifiable by testing of said electrical circuit for removal of said resistor, said testing switch being coupled to an interior side of said faceplate wherein said testing switch is configured for being positioned in a building structure, said testing switch comprising a key hole configured for receiving a key wherein said testing switched being switched into a selectable position by the key, said keyhole being exposed on said exterior side of said faceplate.

2. An alarm system testing device comprising:

an alarm system comprising an electrical circuit, said alarm system including an alarm and at least one trigger, said alarm being activated by said trigger shorting a positive rail of said electrical circuit to a negative rail of said electrical circuit, said alarm system comprising a plurality of resistors electrically coupled to said circuit, only one of said plurality of resistors being positioned at an end of a line subsequent to all of said triggers;

a plurality of testing switches, each said testing switch being electrically coupled to said electrical circuit, each said testing switch being operationally coupled to said electrical circuit with an associated one of said resistors, each said testing switch having a ground position wherein said positive rail of said electrical circuit is grounded when said testing switch is in said ground position, said resistor associated with each said testing switch being electrically coupled to an associated one of said testing switches such that positioning said associated one of said testing switches in a resistor bypass position removes said associated resistor from said electrical circuit whereby said resistor being positioned at the end of the line subsequent to all said triggers is identifiable by testing of said electrical circuit for removal of said resistor, each said testing switch comprising a key hole configured for receiving a key wherein said testing switch is switched into a selectable position by the key, each said testing switch having a passive position wherein said testing switch electrically couples said positive rail to said negative rail through said resistor; and a faceplate configured for coupling to a wall surface exposing an exterior side of said faceplate on the wall surface, said testing switch being coupled to an interior side of said faceplate wherein said testing switch is configured for being positioned in a building structure, said keyhole being exposed on said exterior side of said faceplate.

* * * * *